US011698236B2

(12) United States Patent
Zung et al.

(10) Patent No.: US 11,698,236 B2
(45) Date of Patent: Jul. 11, 2023

(54) GRIP SAFETY INTERLOCK FOR FIREARM

(71) Applicant: Safe Operator Solutions, LLC, Carrollton, GA (US)

(72) Inventors: Michael Zung, San Carlos, CA (US); John Mark Cobb, Carrollton, GA (US)

(73) Assignee: Safe Operator Solutions, LLC, Carrollton, GA (US)

( * ) Notice: Subject to any disclaimer, the term of this patent is extended or adjusted under 35 U.S.C. 154(b) by 0 days.

(21) Appl. No.: 17/565,043

(22) Filed: Dec. 29, 2021

(65) Prior Publication Data

US 2022/0120525 A1 Apr. 21, 2022

Related U.S. Application Data

(62) Division of application No. 17/072,413, filed on Oct. 16, 2020, now Pat. No. 11,243,035.

(51) Int. Cl.

| | |
|---|---|
| ***F41A 17/22*** | (2006.01) |
| ***F41A 17/52*** | (2006.01) |
| *F41A 35/06* | (2006.01) |

(52) U.S. Cl.

CPC ..... *F41A 17/22* (2013.01); *F41A 17/52* (2013.01); *F41A 35/06* (2013.01)

(58) Field of Classification Search

CPC ..... F41A 17/52; F41A 17/22; F41A 17/24; F41A 17/26; F41A 17/28; F41A 17/20; F41A 35/06

USPC ..... 42/70.11, 69.01, 69.03, 70.01, 70.04, 42/70.05, 70.06, 70.07

See application file for complete search history.

(56) References Cited

U.S. PATENT DOCUMENTS 1,333,498 A * 3/1920 Lang ..... F41A 3/40 89/33.02
2,169,084 A * 8/1939 Swartz ..... F41A 17/72 89/154
2,335,669 A * 11/1943 Hanson ..... F41A 17/20 42/70.06
2,379,946 A 7/1945 Baker (Continued)

OTHER PUBLICATIONS

Firearms Tube, "Odin Works Ambi Modular Safety (AMS)", 2018, https:/lwww.youtube.com/watch?v=JGJoloMFJ7Q (accessed Aug. 20, 2020).

(Continued)

*Primary Examiner* — John Cooper
(74) *Attorney, Agent, or Firm* — Thomas Horstemeyer, LLP

(57) ABSTRACT

An example grip safety interlock can include a lower receiver with a trigger assembly, a safety selector having a detent channel, a grip having an internal recess, an extended detent pin having a detent point and an interference abutment surface, a grip safety lever having an interference ledge, and a lever bias spring positioned within the grip, extending between the grip and the grip safety lever. The grip safety lever can be positioned to pivot within the internal recess of the grip, and the extended detent pin can extend within the grip such that the detent point contacts the detent channel of the safety selector. The lever bias spring can push the grip safety lever to a first pivot position such that the interference ledge of the grip safety lever abuts the interference abutment surface of the extended detent pin to prevent movement and rotation of the safety selector.

9 Claims, 10 Drawing Sheets

(56) References Cited

U.S. PATENT DOCUMENTS

| | | | | |
|---|---|---|---|---|
| 3,924,512 | A | 12/1975 | Fagg | |
| 4,002,101 | A | 1/1977 | Tellie | |
| 4,523,510 | A * | 6/1985 | Wilhelm | F41A 19/33 89/142 |
| 6,442,880 | B1 * | 9/2002 | Allan | F41A 17/066 42/70.11 |
| 8,549,982 | B2 | 10/2013 | Troy, Jr. et al. | |
| 8,650,189 | B2 | 2/2014 | Fertik et al. | |
| 9,003,948 | B2 | 4/2015 | Brown | |
| 9,557,128 | B2 | 1/2017 | Miller, III | |
| 9,581,401 | B2 * | 2/2017 | Faxon | F41A 17/22 |
| 9,995,549 | B1 | 6/2018 | Hamby | |
| 10,126,081 | B1 | 11/2018 | Geissele | |
| 10,670,367 | B1 | 6/2020 | Boyer et al. | |
| 10,767,949 | B2 | 9/2020 | Zung et al. | |
| 11,243,035 | B1 * | 2/2022 | Zung | F41A 17/22 |
| 2015/0198401 | A1 | 7/2015 | Locher et al. | |
| 2015/0253093 | A1 * | 9/2015 | Allan | F41A 17/06 42/70.06 |
| 2016/0076842 | A1 * | 3/2016 | Faxon | F41A 17/22 42/69.01 |
| 2016/0084601 | A1 * | 3/2016 | Alicea, Jr. | F41A 19/10 42/6 |
| 2017/0089656 | A1 * | 3/2017 | Alicea, Jr. | F41A 19/69 |
| 2017/0102197 | A1 | 4/2017 | Iosilevsky | |
| 2017/0176122 | A1 | 6/2017 | Underwood | |
| 2017/0219306 | A1 * | 8/2017 | Murphy, II | F41A 17/20 |
| 2017/0299304 | A1 | 10/2017 | Otte, Jr. et al. | |
| 2017/0370668 | A1 | 12/2017 | Locher et al. | |
| 2018/0142979 | A1 | 5/2018 | Troy et al. | |

OTHER PUBLICATIONS

U.S. Patent Application and File History for U.S. Appl. No. 16/413,062, filed May 15, 2019.

U.S. Patent Application and File History for U.S. Appl. No. 16/601,037, filed Oct. 14, 2019.

* cited by examiner

GRIP SAFETY INTERLOCK FOR FIREARM

CROSS-REFERENCE TO RELATED APPLICATION

This application is a divisional of and claims priority to U.S. patent application Ser. No. 17/072,413 entitled "GRIP SAFETY INTERLOCK FOR FIREARM," filed on Oct. 16, 2020, which is incorporated by reference herein in its entirety.

BACKGROUND

A firearm safety is a mechanism to help prevent accidental discharge of the firearm. A number of different types of safety mechanisms are used in different firearms, including internal, external, automatic, and manual types of safety mechanisms, among others. A relatively common type of external, manual safety relies upon a user toggling a lever or button between "safe" and "fire" positions or orientations. In the "safe" position, a mechanical interference of the safety prevents motion of the trigger mechanism and discharge of the firearm. Safety mechanisms provide an important feature in firearms, and users rely upon robust, consistent results from safety mechanisms.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

As noted above, a number of different types of safety mechanisms are used in different firearms, including internal, external, automatic, and manual types of safety mechanisms, among others. A relatively common type of external, manual safety relies upon a user toggling a lever or button between "safe" and "fire" positions or orientations. In the "safe" position, a mechanical interference or other arrangement prevents motion of the trigger mechanism and discharge of the firearm.

Figure 1A:
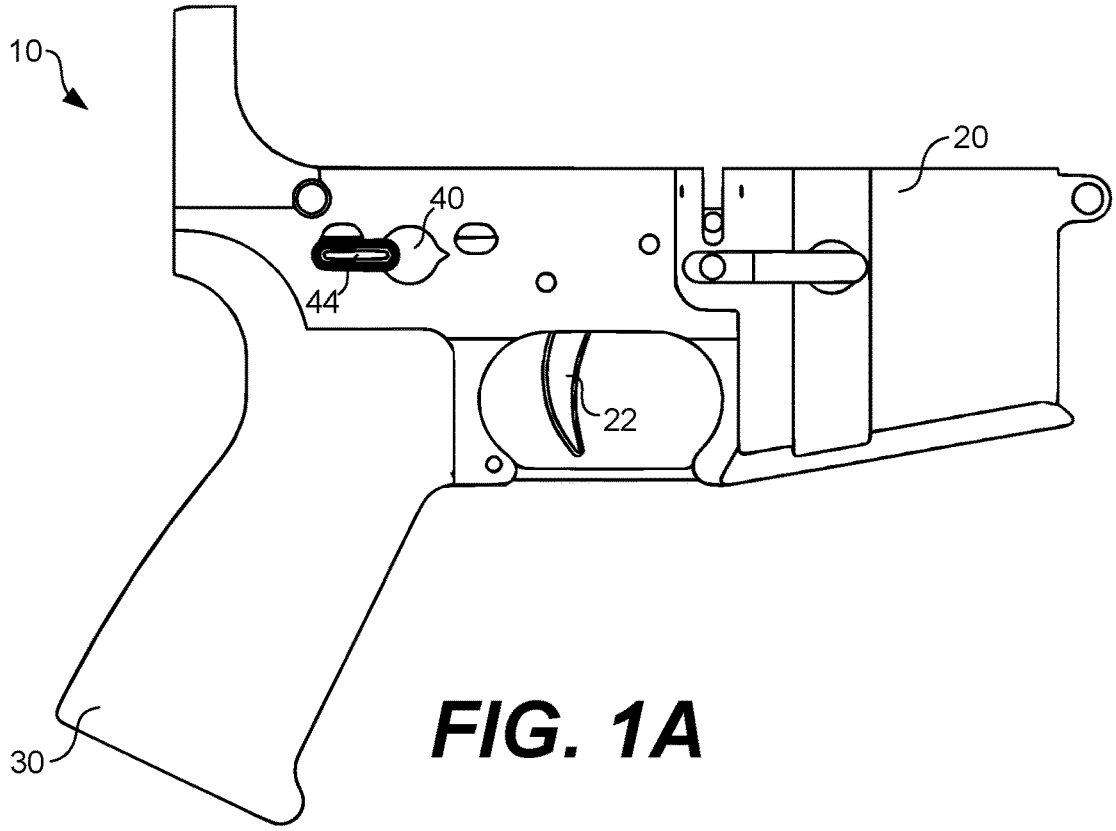
FIG. 1A illustrates an example assembly for a firearm with a safety selector in a first position according to various embodiments of the present disclosure.
Figure 1B:
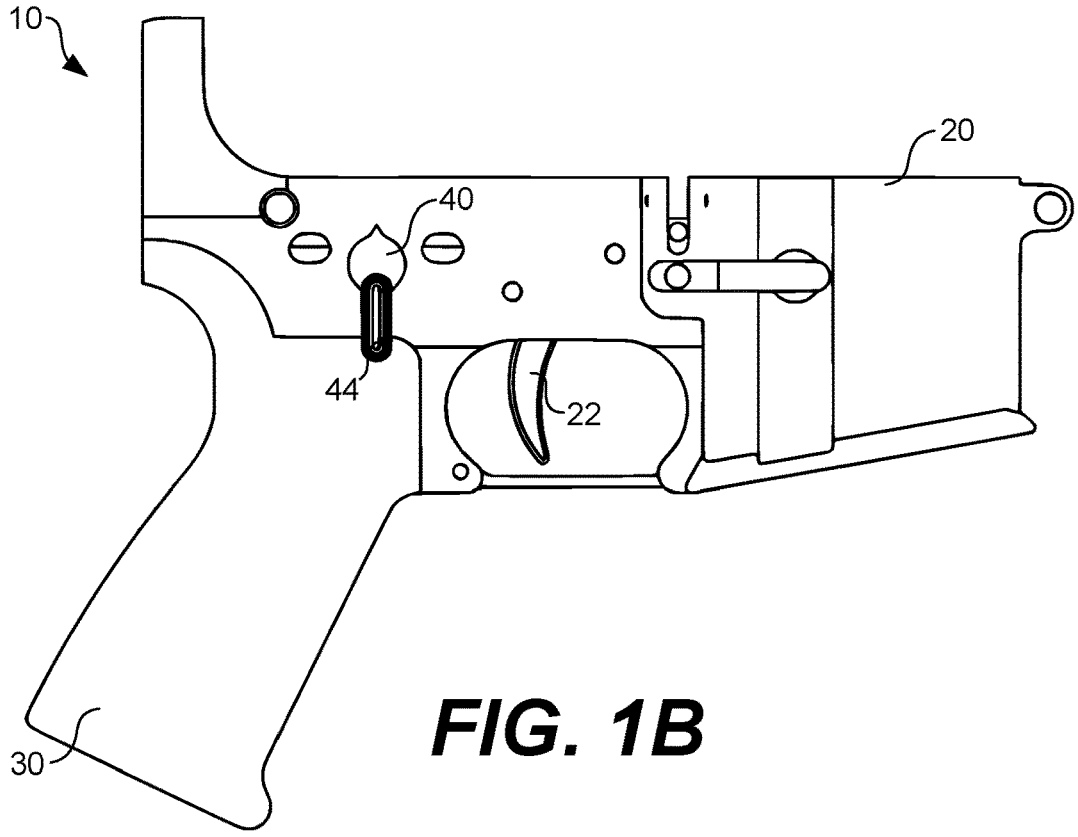
FIG. 1B illustrates the assembly for the firearm shown in FIG. 1A with the safety selector in a second position according to various embodiments of the present disclosure.

In the context of safety mechanisms used for firearms, FIGS. 1A and 1B illustrate an example assembly 10 for part of a firearm with a safety selector according to various embodiments of the present disclosure. The assembly 10 is illustrated as a representative example for the purpose of discussion. Among other components, the assembly 10 can include a lower receiver 20, a trigger assembly 22, a grip 30, and a safety selector 40. The safety selector 40 is installed in the assembly 10 for a left-handed user as shown in FIGS. 1A and 1B, but it should be appreciated that the concepts described herein are applicable to other arrangements and installations of safety selectors (and other types of safety selectors), regardless of whether the user is right or left handed. The assembly 10 is illustrated as parts that can be used in an AR-15 style rifle, for example. However, the concepts described herein are applicable to other assemblies for use with other firearms, including but not limited to M-4 and M-16 rifles.

The lower receiver 20 can be embodied as at least a portion of the frame of the firearm, and it can provide a platform for the integration of other parts or components of the firearm. The lower receiver 20 can provide a housing for some internal action components of the firearm, including the hammer and other parts of the trigger assembly 22. The lower receiver 20 can also include a number of interfaces for attaching components, such as the barrel, stock, grip, and other components. The lower receiver 20 can be formed from forged, machined, or stamped steel or aluminum, polymers, sintered metal powders, or other suitable material or materials.

The safety selector 40 can extend through the lower receiver 20 and can be positioned to rotate relative to (and partly within) the lower receiver 20. Particularly, FIG. 1A illustrates the safety selector 40 rotated to a first angular position, and FIG. 1B illustrates the safety selector 40 rotated to a second angular position. A user of the assembly 10 can toggle (e.g., rotate) the safety selector 40 between the first angular position shown in FIG. 1A and the second angular position shown in FIG. 1B by pushing or pulling on the arm 44 of the safety selector 40 using a thumb, index finger, or other suitable way. As described in further detail below, one or more surfaces of the safety selector 40 can be designed to mechanically interfere with components of the trigger assembly 22 that are within the lower receiver 20, when the safety selector 40 is rotated to the first angular position shown in FIG. 1A, to lock the assembly 10 in a "safe" or "off" position. Alternatively, when the safety selector 40 is rotated to the second angular position shown in FIG. 1B, the safety selector 40 can avoid or not mechanically interfere with the internal components of the trigger assembly 22, such that the assembly 10 in a "fire" or "on" position.

Figure 2:
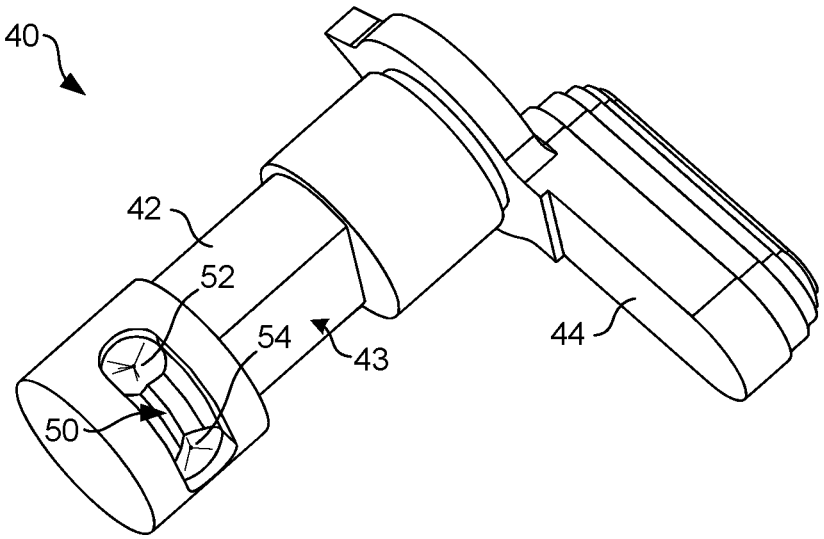
FIG. 2 illustrates the safety selector for the firearm shown in FIGS. 1A and 1B according to various embodiments of the present disclosure.

FIG. 2 illustrates an example of the safety selector 40 according to various embodiments of the present disclosure. The safety selector 40 is illustrated as a representative example, and many different types of safety selectors are known and used in the field. For example, a number of different types of safety selectors are described in U.S. patent application Ser. No. 16/601,037, titled "SAFETY SELECTORS," the entire contents of which is hereby incorporated herein by reference in its entirety. The concepts described herein are not limited to use with any particular type or style of safety selector, however.

As shown, the safety selector 40 can include a body 42, an arm 44 extending from one side of the body 42, and a detent channel 50. The detent channel 50 can include a first detent point 52 and a second detent point 54, positioned at opposite ends of the detent channel 50. The safety selector 40 is typically installed such that the body 42 extends through the lower receiver 20 of the assembly 10 shown in FIGS. 1A and 1B. Depending upon its angular orientation within the assembly 10, features or surfaces of the body 42 can either mechanically interfere with or avoid interference with components of the trigger assembly 22, as would be understood in the field. Particularly, in the orientation of the safety selector 40 shown in FIG. 1A, outer surfaces of the body 42 of the safety selector 40 block activation of the trigger. When the safety selector 40 is rotated to the orientation shown in FIG. 1B, the flat surface 43 faces the trigger, and the clearance allows the trigger to activate when depressed. Additionally, as described below, a detent pin can be used to secure the safety selector 40 at a particular angular position within the lower receiver 20, when the detent pin seats into either the first detent point 52 or the second detent point 54. The safety selector 40 can be formed from forged, machined, or stamped steel or aluminum, polymers, or other suitable material or materials.

Figure 3:
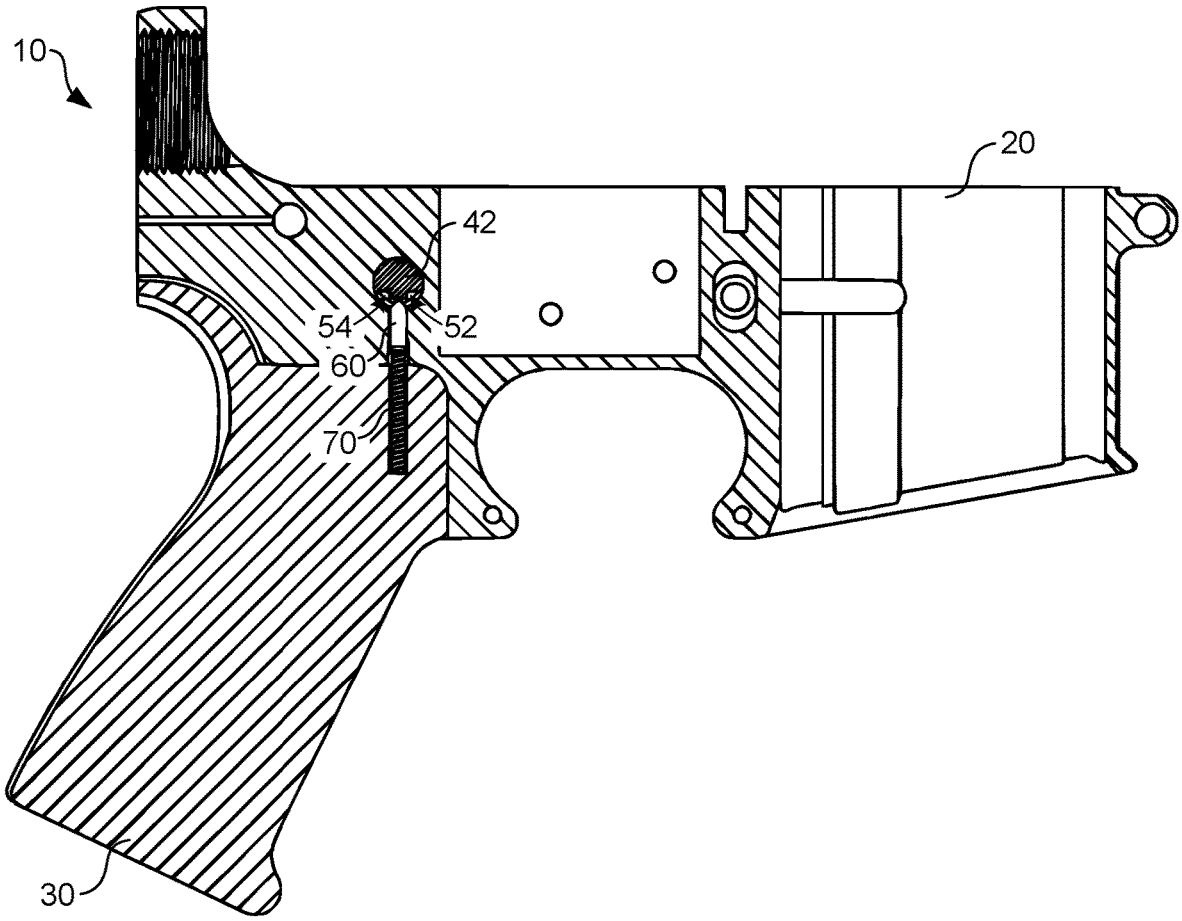
FIG. 3 illustrates a cross-sectional view of the assembly shown in FIGS. 1A and 1B according to various embodiments of the present disclosure.

FIG. 3 illustrates a cross-sectional view of the assembly 10 shown in FIGS. 1A and 1B. In FIG. 3, certain internal components of the assembly 10 are visible. Particularly, a detent pin 60 and a detent spring 70 are shown. Additionally, a cross-section of the body 42 of the safety selector 40 is also shown. The detent spring 70 is positioned in a cylindrical channel that extends within the grip 30. The detent pin 60 is seated and rests upon a first end of the detent spring 70, and a second end of the detent spring 70 is seated at an end of the cylindrical channel in the grip 30, holding the detent spring 70 in place.

In the arrangement shown, the detent spring 70 pushes or biases the detent pin 60 into contact with the detent channel 50 of the safety selector 40. Depending upon the angular orientation of the safety selector 40, the detent pin 60 can fall and seat into either the first detent point 52 or the second detent point 54 of the safety selector 40 (see FIG. 2). The forces provided by the detent spring 70 are sufficient to secure the safety selector 40 into either the "fire" or "safe" positions, when the detent pin 60 is seated into either the first detent point 52 or the second detent point 54, for example, during typical operating conditions. If a sufficient force is applied to the arm 44 of the safety selector 40, however, the detent pin 60 can be forced out of the detent points 52 and 54, overcoming the bias provided by the detent spring 70.

In some circumstances and environments, a user of the assembly 10 may prefer that the safety selector 40 cannot be rotated through forces applied to the arm 44 of the safety selector 40 alone. If the assembly 10 is used with a firearm that is pushed, pulled, or dragged through certain environments, for example, the arm 44 of the safety selector 40 could be inadvertently bumped or contacted, overcoming the bias provided by the detent spring 70. As another example, children or other inexperienced users may inadvertently rotate the safety selector 40 without appreciating the purpose of the safety selector 40, leading to a dangerous situation.

In the context outlined above, various aspects and embodiments of a grip safety interlock are described herein. As described in further detail below, an example grip safety interlock can include a grip having an internal recess, an extended detent pin having a detent point and an interference abutment surface, a grip safety lever having an interference ledge, and a lever bias spring positioned within the grip, extending between the grip and the grip safety lever. The grip safety lever can be positioned to pivot within the internal recess of the grip, and the extended detent pin can extend within the grip such that the detent point contacts a detent channel of the safety selector. The lever bias spring can push the grip safety lever to a first pivot position such that the interference ledge of the grip safety lever abuts the interference abutment surface of the extended detent pin to prevent movement of the detent point and rotation of the safety selector. Thus, the grip safety interlock can prevent the firearm from transitioning from the "safe" or "off" position to the "fire" or "on" position by contact with the safety selector alone. Instead, the safety selector can be rotated only when the grip safety lever is squeezed and pivoted to a second position in which the interference ledge of the grip safety lever clears to allow movement of the extended detent pin.

Figure 4:
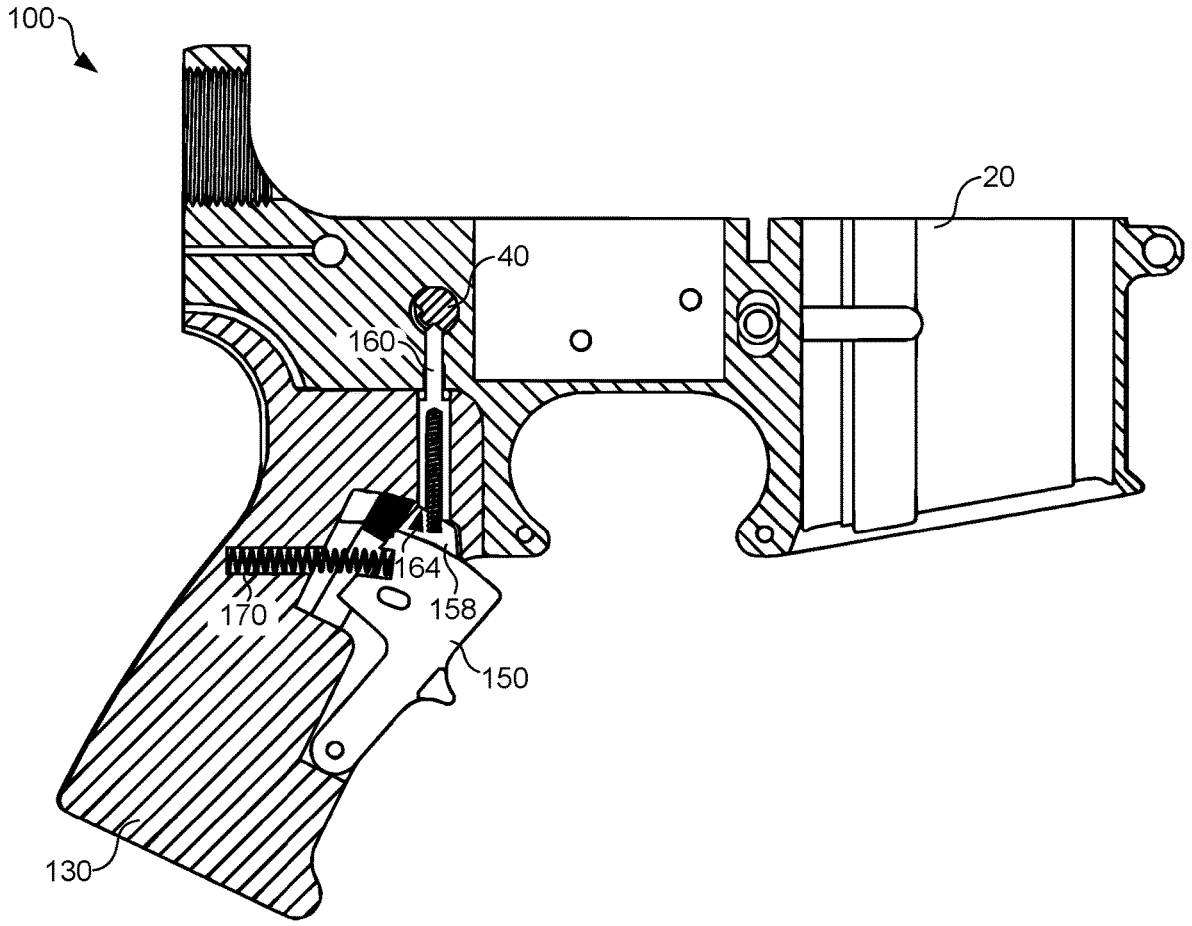
FIG. 4 illustrates a cross-sectional view of an assembly for a firearm including a grip safety interlock according to various embodiments of the present disclosure.

FIG. 4 illustrates a cross-sectional view of an assembly 100 for a firearm including a grip safety interlock according to various embodiments of the present disclosure. The assembly 100 is illustrated as a representative example for the purpose of discussion. The assembly 100 can vary in shape, size, and proportions as compared to that shown. Also, in some cases, certain features or components of the assembly 100 can be omitted, modified, or otherwise varied as compared to that described and illustrated. Among other components, the assembly 100 can include a lower receiver 20, a trigger assembly 22, a grip 130, a safety selector 40, a grip safety lever 150, an extended detent pin 160, and a lever bias spring 170. The assembly 100 can be used in an AR-15 style rife, as one example. However, the concepts are applicable to other assemblies for use with other firearms, including but not limited to M-4 and M-16 rifles.

The lower receiver 20 shown in FIG. 4 can be the same as, or similar to, the lower receiver 20 shown in FIG. 2, and the safety selector 40 shown in FIG. 4, can also be the same as, or similar to, the safety selector 40 shown in FIG. 2. However, to implement a grip safety interlock, the grip 130 shown in FIG. 4 is different than the grip 30 shown in FIG. 3. Additionally, the assembly 100 shown includes the grip safety lever 150 and the lever bias spring 170, which are not part of the assembly 10 shown in FIGS. 1A and 1B (and are not shown in FIG. 3). The extended detent pin 160 shown in FIG. 4 also replaces the detent pin 60 shown in FIG. 3.

A summary of the operation of the assembly 100 is provided with reference to FIG. 4, before a detailed description is provided with reference to the other figures. As shown in FIG. 4, the grip safety lever 150 can be positioned to pivot within an internal recess of the grip 130. The grip safety lever 150 can be pivoted from the first interference position shown in FIG. 4 to a second, clearance position shown in FIG. 10, when the grip 130 and the grip safety lever 150 are squeezed between the palm and fingers of the hand of a user.

The extended detent pin 160 can extend, in part, within the grip 130 as shown in FIG. 4, and a detent point of the extended detent pin 160 can be seated into one of the detent point 52 and 54 (see FIG. 2) of the safety selector 40. At the same time, the lever bias spring 170 can push the grip safety lever 150 to the first interference position shown in FIG. 4, such that an interference ledge 158 of the grip safety lever 150 abuts (e.g., is adjacent to, borders on, ends at) an interference abutment surface 164 of the extended detent pin 160. While the interference ledge 158 abuts the interference abutment surface 164 of the extended detent pin 160, the detent pin 160 (and detent point of the detent pin 160) may be prevented from moving within or relative to the grip 130 or the lower receiver 20, and the grip safety interlock in the assembly 100 can prevent the safety selector 40 from movement.

In the locked configuration shown in FIG. 4, the detent point of the extended detent pin 160 contacts and is locked into one of the detent point 52 and 54 of the safety selector 40. In this locked configuration, the grip safety interlock in the assembly 100 can prevent the firearm from transitioning from the "safe" or "off" position to the "fire" or "on" position by contact with the safety selector 40 alone. Similarly, the grip safety interlock can prevent the firearm from transitioning from the "fire" or "on" position to the "safe" or "off" position by contact with the safety selector 40 alone. Instead, the safety selector 40 can be rotated only when the grip safety lever 150 is squeezed and pivoted to a second position in which the interference ledge 158 of the grip safety lever 150 does not interfere with movement of the extended detent pin 160. A detailed description of the individual components and operation of the assembly 100 is provided with reference to the remaining figures.

Figure 5:
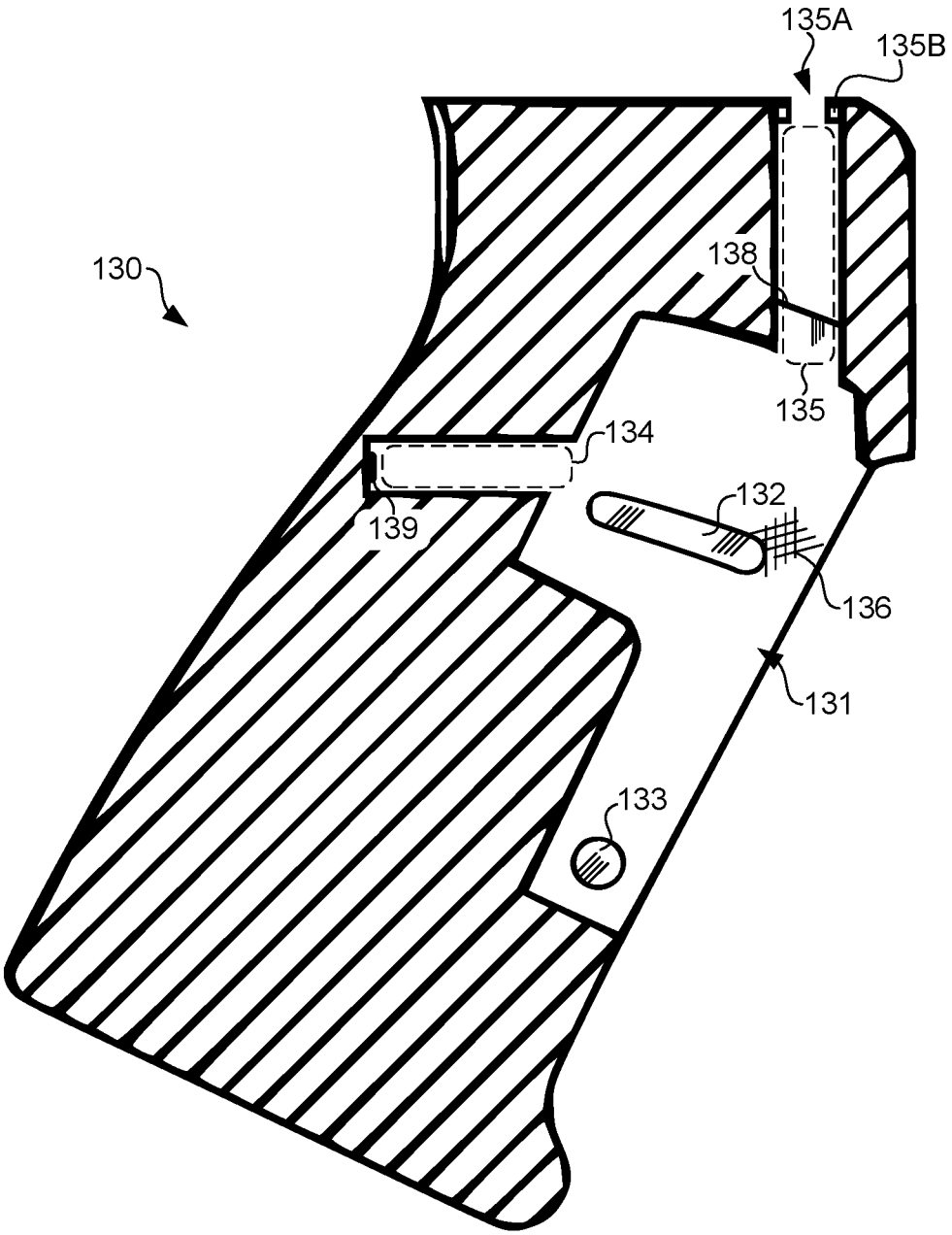
FIG. 5 illustrates a cross-sectional view of a grip for a firearm including a grip safety interlock according to various embodiments of the present disclosure.

FIG. 5 illustrates a cross-sectional view of the grip 130 according to various embodiments of the present disclosure. The grip 130 is shown as a representative example in FIG. 5. The grip 130 can vary in shape, size, and proportions as compared to that shown. Also, in some cases, certain features of the grip 130 can be omitted, modified, or otherwise varied as compared to that described and illustrated. The grip 130 can be formed from any suitable material or materials, including polymers, rubber over-molded polymers, metals, or other materials.

As shown in FIG. 5, the grip 130 can include that an internal recess 131, a first slide channel 132, a first pivot eyelet 133, a bias spring recess 134, and a detent pin aperture 135. Both the first slide channel 132 and the first pivot eyelet 133 can be formed as recesses that extend into the solid material of the grip 130, from the surface 136 of the internal recess 131. The cross-sectional view shown in FIG. 5 is taken through a relative center of the width (i.e., as directed into the page) of the internal recess 131. Although not shown in FIG. 5, the grip 130 can also include a second slide channel and a second pivot eyelet, both of which are positioned at locations that correspond with the first slide channel 132 and the first pivot eyelet 133, but at the other side of the internal recess 131.

When the assembly 100 is assembled (see, e.g., FIGS. 4, 9, and 10), the grip safety lever 150 can be pivotably positioned within the internal recess 131 of the grip 130. A pivot guide and a pivot pin of the grip safety lever 150, which are described below with reference to FIGS. 6A-6D, can fit into the first pivot eyelet 133 and the first slide channel 132 of the grip 130, respectively, permitting the grip safety lever 150 to pivot within the internal recess 131 of the grip 130.

The grip 130 can vary in certain aspects as compared to that shown in FIG. 5. For example, the first slide channel 132 (and any corresponding second slide channel) can be omitted from the grip 130, as it may be unnecessary in some cases. Alternatively, rather than being formed as a depression into the grip 130, the first slide channel 132 can be formed as a type of pivot guide or pin that extends out or off of the surface 136 of the internal recess 131, and the grip safety lever 150 can include a channel similar to the slide channel 132 shown in FIG. 5. Other variations are within the scope of the embodiments.

The lever bias spring 170 can also be positioned within the bias spring recess 134 when the assembly 100 is assembled. The lever bias spring 170 can be embodied as a coil spring of a suitable size and spring constant, although any suitable type of spring can be relied upon. In one embodiment, a first distal end of the lever bias spring 170 can be seated against the spring mount 139 at one end of the bias spring recess 134, but the spring mount 139 can be omitted in some cases. The lever bias spring 170 can push the grip safety lever 150 to pivot out of the internal recess 131 of the grip 130, to the extent possible.

The extended detent pin 160 can also be positioned within the detent pin aperture 135 when the assembly 100 is assembled. A top portion of the extended detent pin 160 can extend through the aperture eyelet 135A at the top of the grip 130. In one embodiment, an eyelet rim 135B at the top end of the detent pin aperture 135 provides a mechanical interference, preventing the bottom portion of the extended detent pin 160 from sliding out through the aperture eyelet 135A at the top of the grip 130. However, the eyelet rim 135B can be omitted in some cases. Additionally, in one embodiment, the detent pin aperture 135 can include a locking ledge recess 138, which is an additional recess in the detent pin aperture 135. A corresponding locking ledge of the extended detent pin 160 can lock or rest against the locking ledge recess 138, as described in further detail below with reference to FIGS. 7A-7C. The locking ledge recess 138 can be omitted in some cases.

Figure 6A:
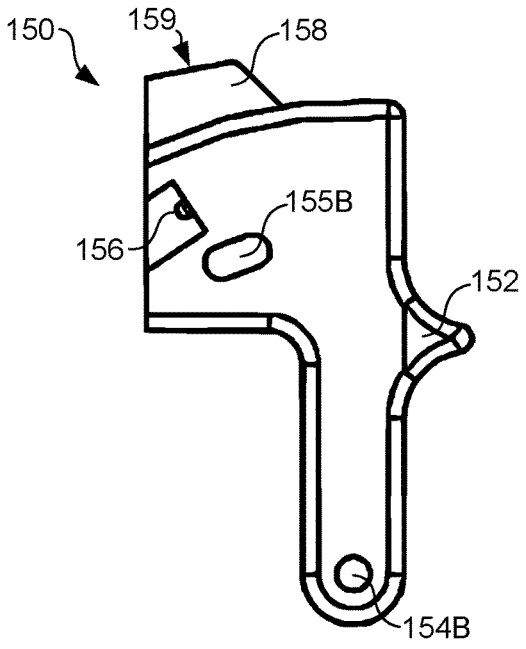
FIGS. 6A-6D illustrate various views of a grip safety lever used in the assembly for the firearm shown in FIG. 4 according to various embodiments of the present disclosure.
Figure 6B:
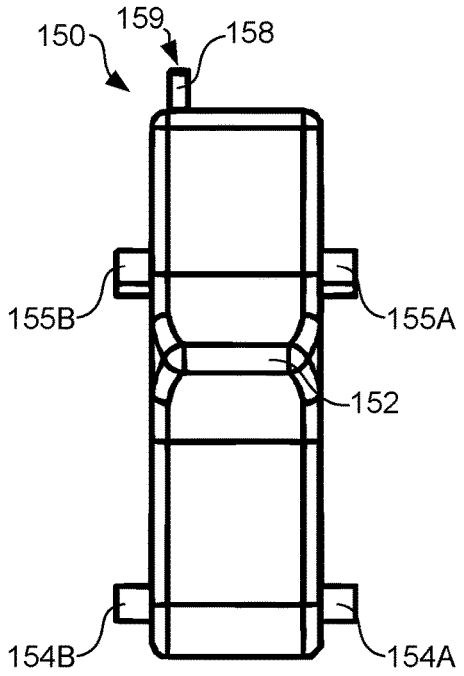
Figure 6C:
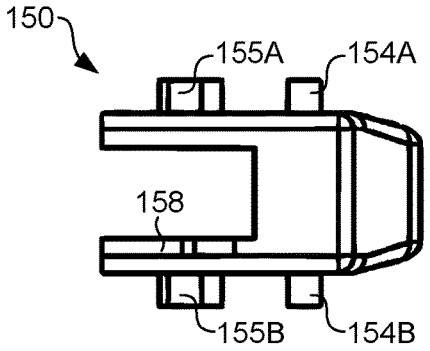
Figure 6D:
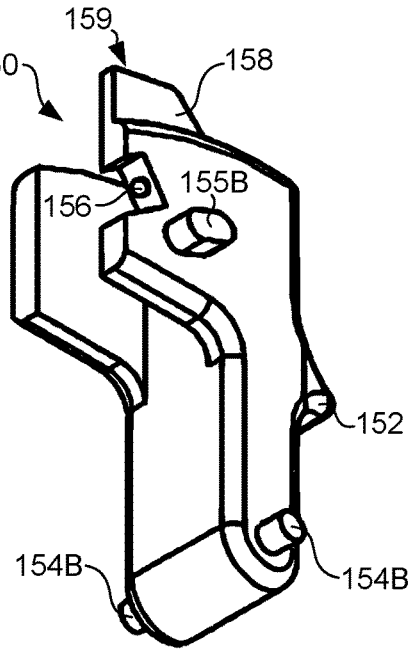

FIG. 6A illustrates a right-side view of the grip safety lever 150 used in the assembly 100, FIG. 6B illustrates a front view of the grip safety lever 150, FIG. 6C illustrates a top-down view of the grip safety lever 150, and FIG. 6D illustrates a bottom-up perspective view of the grip safety lever 150. The grip safety lever 150 is shown as a representative example in FIGS. 6A-6D. The grip safety lever 150 can vary in shape, size, and proportions as compared to that shown. Also, in some cases, certain features of the grip safety lever 150 can be omitted, modified, or otherwise varied as compared to that described and illustrated. The grip safety lever 150 can be formed from any suitable material or materials, including polymers, rubber over-molded polymers, metal, or other materials.

As shown, the grip safety lever 150 can include a finger ledge 152, pivot pins 154A and 154B, pivot guides 155A and 155B, a spring mount 156, and an interference ledge 158. When the grip safety lever 150 is installed in the grip 130, the grip safety lever 150 can be pivotably positioned within the internal recess 131 of the grip 130. Particularly, the pivot guide 155A and the pivot pin 154A can fit into the first pivot eyelet 133 and the first slide channel 132 of the grip 130 (FIG. 5), respectively. The pivot guide 155B and the pivot pin 154B can fit into a second pivot eyelet and second slide channel of the grip 130.

The grip safety lever 150 can vary in certain aspects as compared to that shown in FIG. 6A-6D. For example, the pivot guides 155A and 155B can be omitted from the grip safety lever 150. Alternatively, channels can be formed in the grip safety lever 150, in place of the pivot guides 155A and 155B. Other variations are within the scope of the embodiments.

Figure 9:
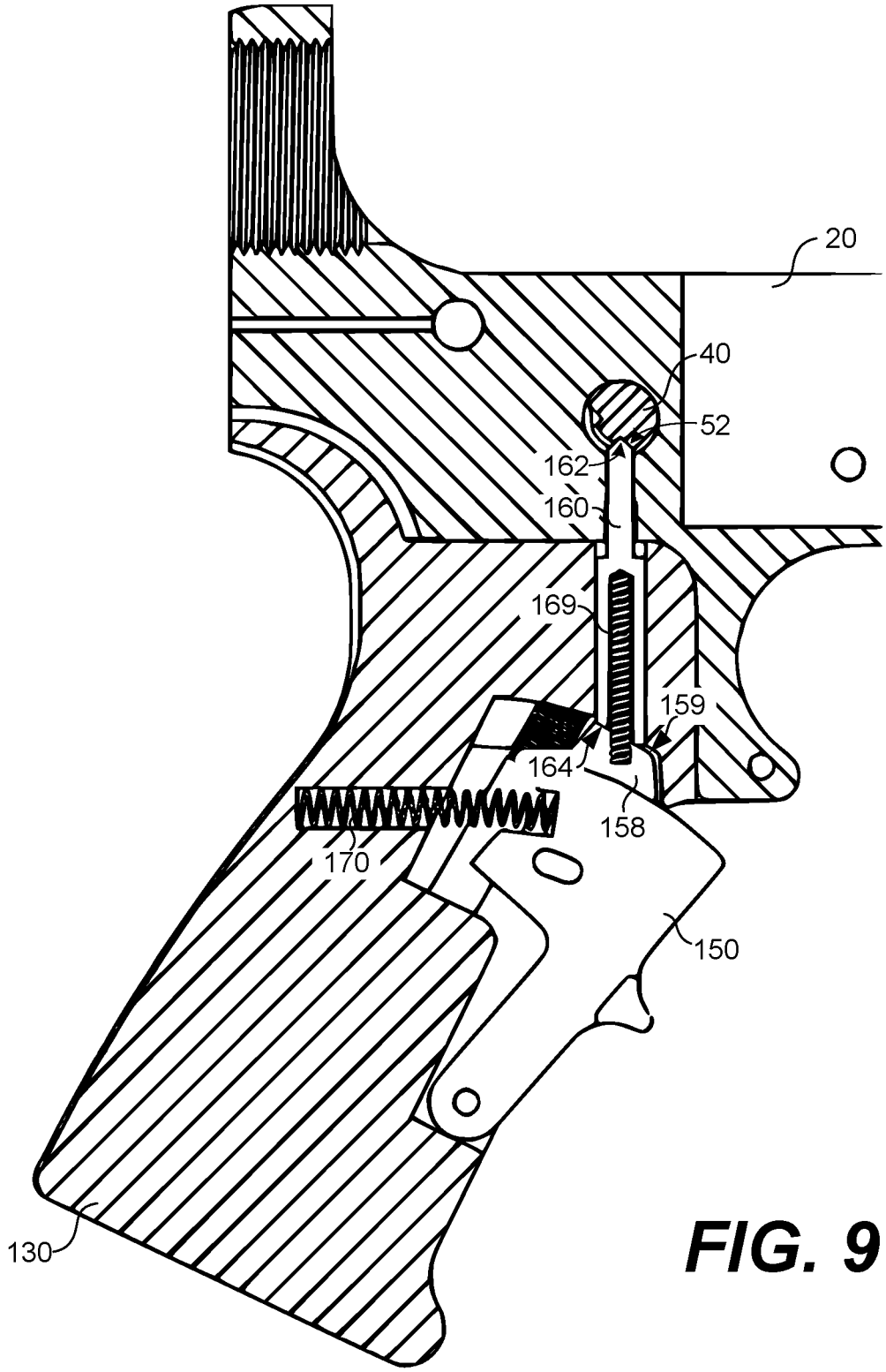
FIG. 9 illustrates a cross-sectional view of the assembly shown in FIG. 4 with the safety selector locked in a first interference position according to various embodiments of the present disclosure.

A second distal end of the lever bias spring 170 can be seated against the spring mount 156 of the grip safety lever 150. The lever bias spring 170 can push the grip safety lever 150 to pivot out of the internal recess 131 of the grip 130, to the extent possible before the interference ledge 158 abuts against internal surfaces of the grip 130, preventing further movement. When the lever bias spring 170 pushes the grip safety lever 150 out, as shown in FIGS. 4 and 9, the grip safety lever 150 is in a first interference pivot position. An upper interference surface 159 of the interference ledge 158 can abut against the interference abutment surface 164 of the extended detent pin 160 in this first interference pivot position. In the first interference pivot position, the bottom portion of the extended detent pin 160 can be secured within the detent pin aperture 135, to substantially prevent movement of the extended detent pin 160. To substantially prevent movement in this context can mean to completely prevent all movement of the extended detent pin 160. However, manufacturing and design tolerances may result in slight variations in the proportions and sizes of certain components, including the grip 130, the grip safety lever 150, and the extended detent pin 160. Thus, a small amount of movement might still occur among the components due to these manufacturing and design tolerances, even when the interference ledge 158 of the grip safety lever 150 abuts against the interference abutment surface 164 of the extended detent pin 160.

Figure 7A:
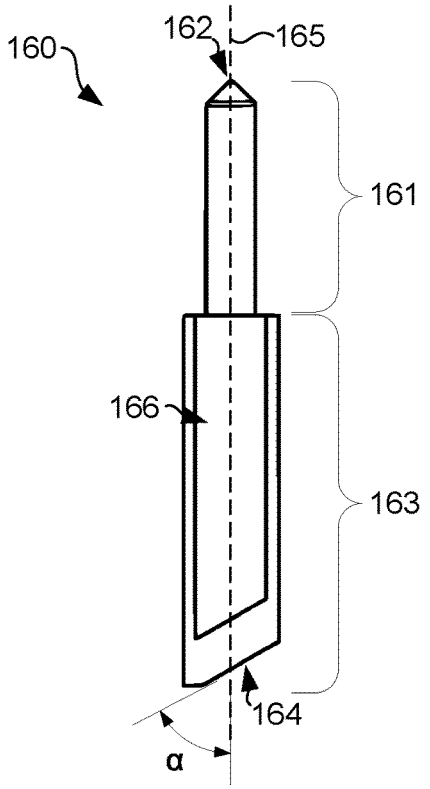
FIGS. 7A-7C illustrate various views of an extended detent pin used in the assembly for the firearm shown in FIG. 4 according to various embodiments of the present disclosure.
Figure 7B:
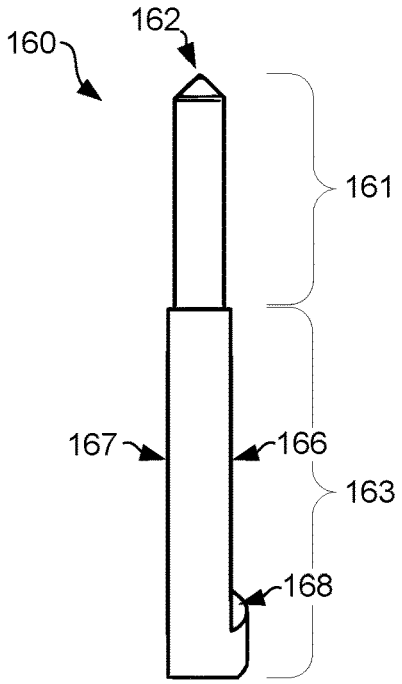
Figure 7C:
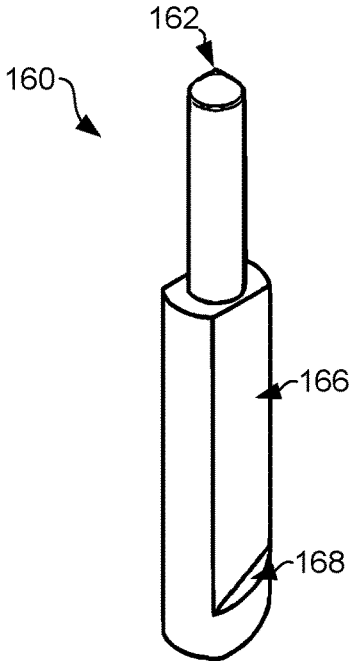

FIG. 7A illustrates a right side view of the extended detent pin 160 used in the assembly 100, FIG. 7B illustrates a back view of the extended detent pin 160, and FIG. 7B illustrates a top-down perspective view of the extended detent pin 160. The extended detent pin 160 is shown as a representative example in FIGS. 7A-7C. The extended detent pin 160 can vary in shape, size, and proportions as compared to that shown. Also, in some cases, certain features of the extended detent pin 160 can be omitted, modified, or otherwise varied as compared to that described and illustrated. The extended detent pin 160 can be formed from forged, machined, or stamped steel or aluminum, polymers, or other suitable material or materials.

As shown, the extended detent pin 160 can include a top portion 161 and a bottom portion 163, which both extend along a longitudinal axis 165 of the extended detent pin 160. In one example, the top portion 161 is cylindrical in shape, and the bottom portion 163 is also cylindrical in shape but also includes the keying surfaces 166 and 167 on opposite sides of the bottom portion 163. Both the keying surfaces 166 and 167 are formed as flat surfaces on the extended detent pin 160. The keying surface 167 extends from the top of the bottom portion 163 of the extended detent pin 160 to the interference abutment surface 164. The keying surface 166, on the other hand, extends from the top of the bottom portion 163 but does not extend to the interference abutment surface 164. The overall size of the interference abutment surface 164 is increased in that way, to ensure sufficient contact between the interference abutment surface 164 and the interference surface 159 of the interference ledge 158 as described in further detail below.

The keying surface 166, the keying surface 167, or both can be formed to avoid mechanical interference with the frame 20, the grip 130, or both, permitting the extended detent pin 160 to move or slide freely. In another aspect, the keying surfaces 166 and 167 can maintain the extended detent pin 160 in the proper orientation (e.g., to prevent the extended detent pin 160 from rotating) within the frame 20 and the grip 130 to ensure proper engagement between the interference abutment surface 164 and the interference surface 159 of the interference ledge 158. However, one or both of the keying surfaces 166 and 167 can be omitted in some cases. Additionally, the extended detent pin 160 can be formed in other suitable shapes in other embodiments.

The top portion 161 can include a detent point 162, and the bottom portion 163 can include the interference abutment surface 164. The interference abutment surface 164 can extend at an angle $\alpha$ relative to the longitudinal axis 165 of the extended detent pin 160. The bottom portion 163 can also include the locking ledge 168. In some cases, when the extended detent pin 160 is installed in the grip 130, the locking ledge 168 can interlock with the locking ledge recess 138 of the grip 130 when the grip safety lever 150 is pushed out to the first interference pivot position. However, one or both of the locking ledge 168 and the locking ledge recess 138 can be omitted in some cases.

Figure 8A:
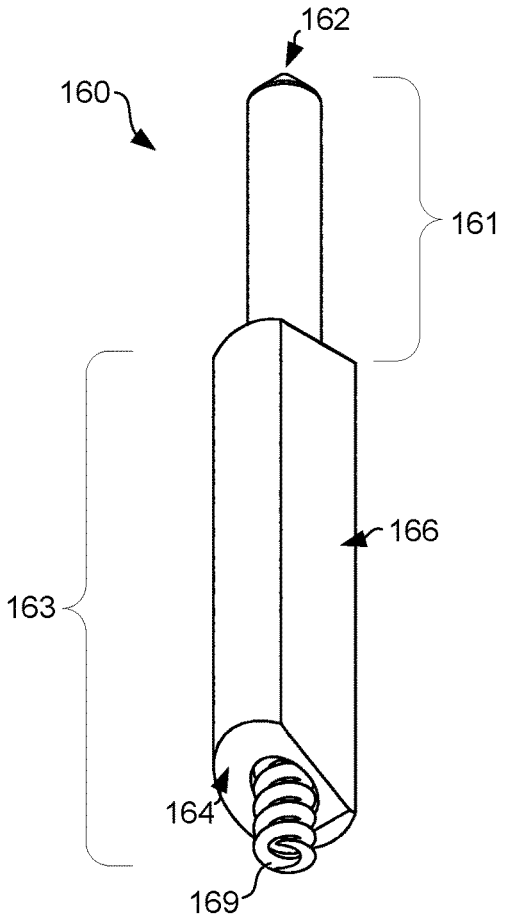
FIG. 8A illustrates the extended detent pin shown in FIGS. 6A-6C with a detent pin spring according to various embodiments of the present disclosure.
Figure 8B:
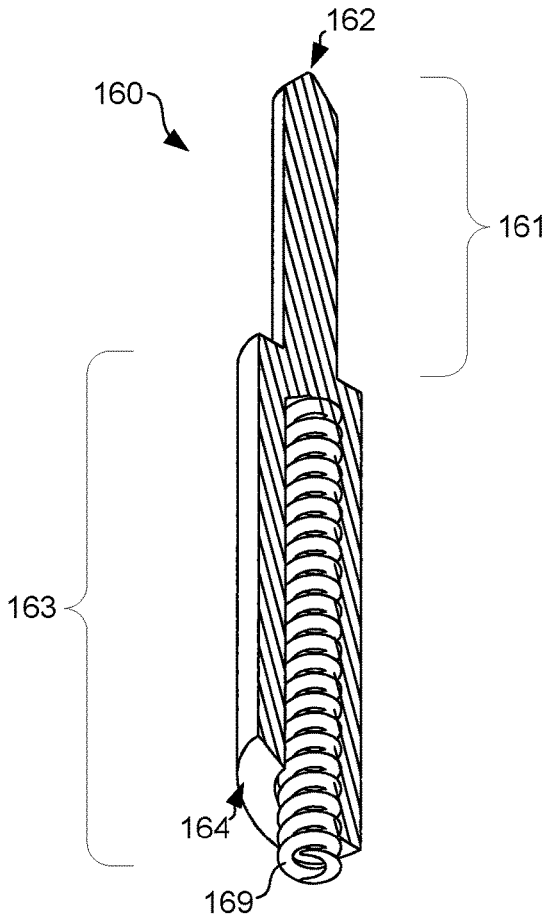
FIG. 8B illustrates a cross sectional view of the extended detent pin shown in FIG. 7A according to various embodiments of the present disclosure.

FIG. 8A illustrates a bottom-up perspective view of the extended detent pin 160, with a detent pin spring 169 extending out through an aperture or opening in the interference abutment surface 164 of the extended detent pin 160. FIG. 8B illustrates a cross-sectional view of the extended detent pin 160, to show how the detent pin spring 169 extends within the extended detent pin 160. When the extended detent pin 160 is installed in the grip 130, the bottom end of the detent pin spring 169 can be seated within the grip 130. When the grip safety lever 150 is pushed out to the first interference pivot position, the surface 159 of the interference ledge 158 of the grip safety lever 150 can abut the interference abutment surface 164 of the extended detent pin 160, as shown in FIGS. 4 and 9. In this configuration, the detent pin spring 169 cannot be further compressed because the extended detent pin 160 is locked in place. The safety selector 40 is locked in this case even if force is applied to the arm 44. However, when the grip safety lever 150 is pulled or squeezed to the second position shown in FIG. 10, the interference ledge 158 can avoid interference with the abutment surface 164. In this configuration, the detent pin spring 169 can be compressed further, and the detent point 162 can move. If a sufficient force is applied to the arm 44 of the safety selector 40 in this case, the detent pin 60 can be forced out of the detent points 52 and 54, overcoming the bias provided by the detent pin spring 169.

FIG. 9 illustrates a cross-sectional view of the assembly 100 shown in FIG. 4 with the safety selector 40 locked in a first interference position according to various embodiments of the present disclosure. As shown, the grip safety lever 150 can be pushed out to the first interference pivot position based on the bias provided by the lever bias spring 170. In this arrangement, the interference ledge 158 of the grip safety lever 150 can abut the interference abutment surface 164 of the extended detent pin 160. The detent pin spring 169 is fully extended, without being compressed, and cannot be compressed in this configuration, because the extended detent pin 160 is locked in place. The safety selector 40 can also be locked in this configuration, because the detent point 162 is seated and locked into the first detent point 52 of the safety selector 40. In this case, while the interference ledge 158 abuts the interference abutment surface 164 of the extended detent pin 160, the detent pin 160 (and detent point of the detent pin 160) cannot move within or with respect to the grip 130 or the lower receiver 20, and the grip safety interlock in the assembly 100 prevents the safety selector 40 from movement.

Figure 10:
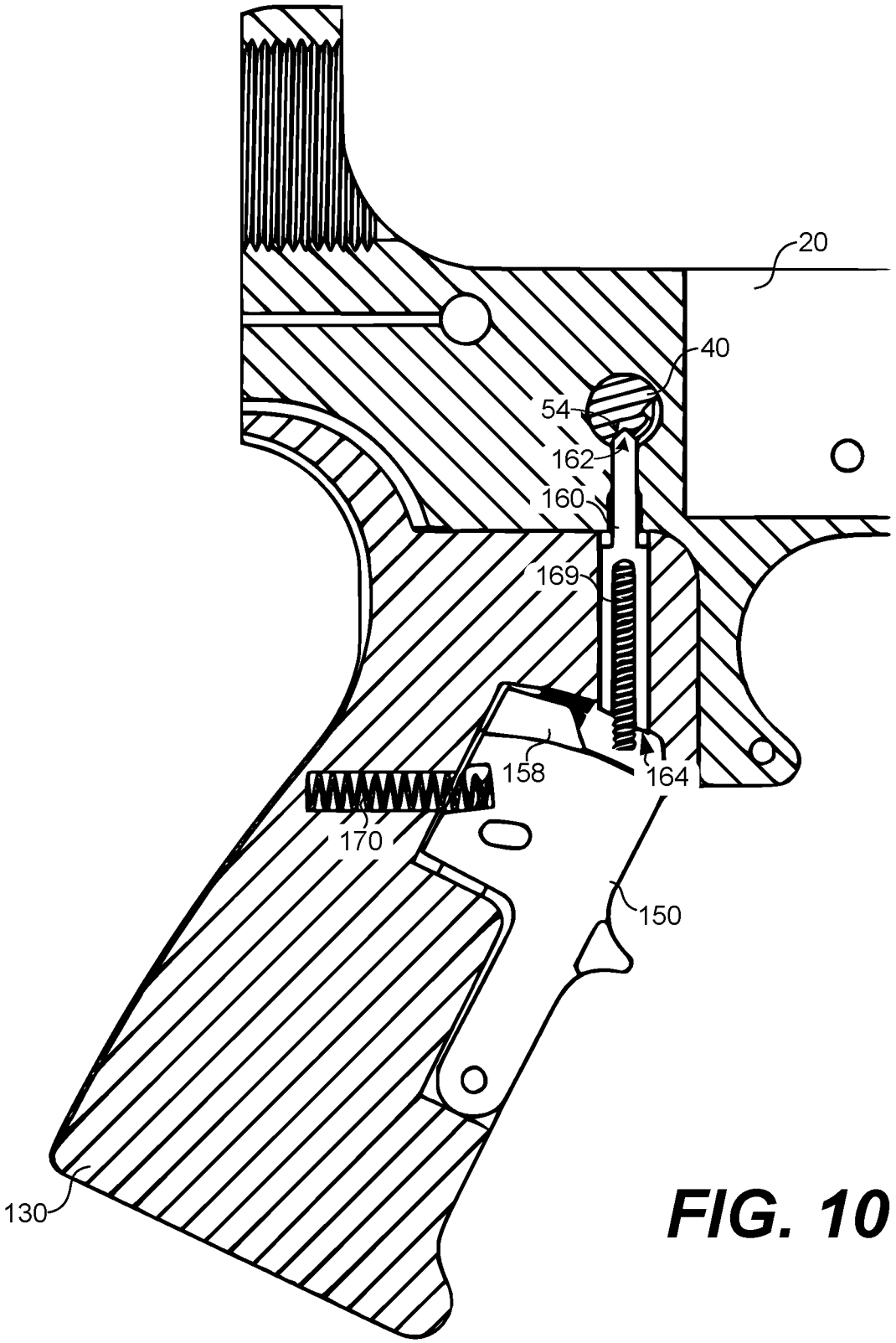
FIG. 10 illustrates a cross-sectional view of the assembly shown in FIG. 4 with the safety selector unlocked and in a second clearance position according to various embodiments of the present disclosure.

FIG. 10 illustrates a cross-sectional view of the assembly 100 shown in FIG. 4 with the safety selector 40 unlocked and rotated to a second clearance position according to various embodiments of the present disclosure. As shown, when the grip safety lever 150 is pulled or squeezed to the second position, the interference ledge 158 can avoid interference with the abutment surface 164. In this configuration, the detent pin spring 169 can be compressed, and the detent point 162 can move. If a sufficient force is applied to the arm 44 of the safety selector 40 in this case, the detent pin 160 can be forced out of and move between the detent points 52 and 54 of the safety selector 40, overcoming the bias provided by the detent pin spring 169.

With the grip safety interlock, the safety selector 40 may be prevented from being rotated through forces applied to the arm 44 of the safety selector 40 alone. Thus, if the assembly 100 is used with a firearm that is pushed, pulled, or dragged through certain environments, the safety selector 40 cannot be moved by merely bumping or contacting the arm 44 of the safety selector 40. Additionally, it is more difficult for children or other inexperienced users to inadvertently rotate the safety selector 40 without appreciating the purpose of the safety selector 40.

Conditional language used herein, such as the words and phrases "can," "could," "might," "may," "e.g.," and the like, unless specifically stated or indicated otherwise, is generally intended to convey that certain embodiments include, while other embodiments do not include, certain features, elements, and/or steps. Thus, such conditional language is generally not intended to imply that features, elements, and/or steps are in any way required for one or more embodiments. The terms "comprising," "including," "having," and the like are synonymous and are used inclusively, in an open-ended fashion, and do not exclude additional elements, features, acts, operations, and so forth. Also, the term "or" is used in its inclusive sense, and not in its exclusive sense, so that when used, for example, to connect a list of elements, the term "or" means one, some, or all of the elements in the list.

Disjunctive language, such as the phrase "at least one of X, Y, Z," unless indicated otherwise, is used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Numerical ranges described herein are used for convenience and brevity and thus should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to about 5%" should be interpreted to include not only the explicitly recited values of about 0.1% to about 5%, but also include individual values (e.g., 1%, 2%, 3%, and 4%) and the sub-ranges (e.g., 0.5%, 1.1%, 2.2%, 3.3%, and 4.4%) within the indicated range. Where the stated range includes one or both of the limits, ranges excluding either or both of those included limits are also included in the disclosure. For example, the phrase "x to y" includes the range from "x" to "y" as well as the range greater than "x" and less than "y." The range can also be expressed as an upper limit. For example, "about x, y, z, or less" and should be interpreted to include the specific ranges of "about x," "about y," and "about z," as well as the ranges of "less than x," "less than y," and "less than z." Likewise, the phrase "about x, y, z, or greater" should be interpreted to include the specific ranges of "about x," "about y," and "about z," as well as the ranges of "greater than x," "greater than y," and "greater than z." In some embodiments, the term "about" can include traditional rounding according to significant figures of the numerical value. In addition, the phrase "about 'x' to 'y'", where 'x' and 'y' are numerical values, includes "about 'x' to about 'y'."

The above-described embodiments of the present disclosure are merely examples of implementations to provide a clear understanding of the principles of the present disclosure. Many variations and modifications can be made to the above-described embodiments without departing substantially from the spirit and principles of the disclosure. In addition, components and features described with respect to one embodiment can be included in another embodiment. All such modifications and variations are intended to be included herein within the scope of this disclosure.

What is claimed is:

1. A grip assembly for a firearm, comprising:

a firearm grip comprising an internal recess;

a sliding firearm safety selector detent pin comprising a detent point at a first end and an interference abutment surface at a second end, the firearm safety selector detent pin extending within the firearm grip, the firearm safety selector detent pin being structured and designed to contact a firearm safety selector; and a grip safety lever positioned within the internal recess of the firearm grip, the grip safety lever positioned to pivot between an interference position and a clearance position, wherein in the interference position, an interference ledge of the grip safety lever abuts the interference abutment surface of the firearm safety selector detent pin to substantially prevent movement of the detent point.

2. The grip assembly according to claim 1, further comprising a lever bias spring positioned within the firearm grip, extending between the firearm grip and the grip safety lever, and biasing the grip safety lever to the interference position.

3. The grip assembly according to claim 1, wherein the firearm grip further comprises a slide channel, a pivot eyelet, a bias spring recess, and a detent pin aperture.

4. The grip assembly according to claim 3, wherein the grip safety lever comprises a pivot pin, a pivot guide, and the interference ledge.

5. The grip assembly according to claim 4, wherein the grip safety lever is positioned to pivot within the internal recess of the firearm grip, with the pivot pin seated into the pivot eyelet of the firearm grip and the pivot guide seated into the slide channel of the firearm grip.

6. The grip assembly according to claim 1, wherein the firearm safety selector detent pin further comprises a spring aperture opening at the second end of the firearm safety selector detent pin and a detent spring that extends in part within the firearm safety selector detent pin.

7. The grip assembly according to claim 1, wherein the interference abutment surface of the firearm safety selector detent pin is angled with respect to a longitudinal axis of the firearm safety selector detent pin.

8. A grip assembly for a firearm, comprising:

a firearm grip;

a sliding firearm safety selector detent pin comprising an interference abutment surface, the firearm safety selector detent pin being structured and designed to contact a firearm safety selector; and a grip safety lever positioned within the firearm grip and configured to pivot between an interference position and a clearance position, wherein in the clearance position, the grip safety lever is positioned to avoid contact with the interference abutment surface and permit movement of the firearm safety selector detent pin.

9. The grip assembly according to claim 8, wherein, in the interference position, an interference ledge of the grip safety lever abuts the interference abutment surface of the firearm safety selector detent pin to substantially prevent movement of the firearm safety selector detent pin.

* * * * *